US006309482B1

(12) United States Patent
Dorricott et al.

(10) Patent No.: US 6,309,482 B1
(45) Date of Patent: Oct. 30, 2001

(54) STECKEL MILL/ON-LINE CONTROLLED COOLING COMBINATION

(76) Inventors: Jonathan Dorricott, 2810 - E. 44th St., Davenport, IA (US) 52807; William R. Frank, 3905 Praire La., Bettendorf, IA (US) 52722

( * ) Notice: Subject to any disclaimer, the term of this patent is extended or adjusted under 35 U.S.C. 154(b) by 0 days.

(21) Appl. No.: 09/573,133

(22) Filed: May 17, 2000

Related U.S. Application Data

(63) Continuation-in-part of application No. 09/157,075, filed on Sep. 18, 1998, now abandoned, which is a continuation of application No. 08/594,704, filed on Jan. 31, 1996, now Pat. No. 5,810,951, and a continuation-in-part of application No. 09/350,314, filed on Jul. 9, 1999, which is a continuation-in-part of application No. 08/870,470, filed on Jun. 6, 1997, now Pat. No. 5,924,318.

(51) Int. Cl.[7] ..... C21D 8/02

(52) U.S. Cl. ..... 148/654; 148/648; 148/602; 266/103; 266/113; 72/203; 72/365.2

(58) Field of Search ..... 72/203, 365.2, 72/229, 201; 148/654, 648, 602; 266/103, 113

(56) References Cited

U.S. PATENT DOCUMENTS

| | | |
|---|---|---|
| 4,583,387 | 4/1986 | Thomas et al. . |
| 4,658,363 | 4/1987 | Tippins et al. . |
| 4,675,974 | 6/1987 | Connolly . |
| 4,745,556 | 5/1988 | Turley . |
| 4,881,392 | 11/1989 | Thompson et al. . |
| 5,276,952 | 1/1994 | Thomas et al. . |
| 5,414,923 | 5/1995 | Thomas et al. . |
| 5,467,519 | 11/1995 | Tippins et al. . |
| 5,499,523 | 3/1996 | Ginzburg . |
| 5,727,412 | 3/1998 | Tippins et al. . |

FOREIGN PATENT DOCUMENTS 26 30 877 11/1977 (DE) .

(List continued on next page.)

OTHER PUBLICATIONS

*The Making, Shaping and Treating of Steel,* 10th Edition, 1986, published by the Association of Iron & Steel Engineers, Chapter 41, Section 8, pp. 782–785.

*On the Fundamentals of HSLA Steels,* Cohen and Hansen, HSLA Steels Metallurgical Applications, Proceedings and Conference, Beijing, China, 1985, pp. 61–70.

(List continued on next page.)

*Primary Examiner*—Deborah Yee
(74) *Attorney, Agent, or Firm*—Robert H. Barrigar

(57) ABSTRACT

The in-line combination of a reversing rolling mill (Steckel mill) and its coiler furnaces with accelerated controlled cooling apparatus immediately downstream thereof and associated method permits steel to be sequentially reversingly rolled to achieve an overall reduction of at least about 3:1, imparted by a first reduction while the steel is kept at a temperature above the $T_{nr}$ by the coiler furnaces so as to preserve an optimum opportunity for controlled recrystallization of the steel after each rolling pass, and a second reduction while the temperature of the steel drops from about the $T_{nr}$ to about the $Ar_3$. The second reduction is preferably of the order of 2:1 as a result of which the steel reaches a final plate thickness. The steel product then passes through the accelerated controlled cooling apparatus, preferably applying laminar flow cooling at least to the upper surface of the steel passing therethrough so as to reduce the temperature of the steel from about the $Ar_3$ to a temperature at least about 250° C. to about 300° C. or more below the $Ar_3$ at a cooling rate of at about 12° C. to about 20° C. and preferably about 15° C. per second, thereby to achieve a preferred fine-grained predominantly bainite structure affording enhanced strength and toughness in the final steel product.

44 Claims, 5 Drawing Sheets

FOREIGN PATENT DOCUMENTS

| | | |
|---|---|---|
| 29 135 84 | 10/1979 | (DE) . |
| 0 099 520 | 2/1984 | (EP) . |
| 0 123 406 | 10/1984 | (EP) . |
| 0 177 187 | 4/1986 | (EP) . |
| 0 666 332 | 8/1995 | (EP) . |
| 2 011 673 | 2/1979 | (GB) . |
| 2 129 723 | 5/1984 | (GB) . |
| 2 134 022 | 8/1984 | (GB) . |
| 62-174323 | 7/1987 | (JP) . |
| 62-196325 | 8/1987 | (JP) . |
| 86/01231 | 2/1986 | (WO) . |
| 92/21454 | 12/1992 | (WO) . |
| 95/13149 | 5/1995 | (WO) . |

OTHER PUBLICATIONS

*Intensive Cooling:* 3.7m *Heavy Plate Mill,* Thyssen Stahl AG, Buisburg–Süd/B.R. Deutschland.

*Production and Characteristics of Thermal–Mechanically Rolled Hot Strip* by Wolfgang Bleck, Lutz Meyer in Neue Hütte, 1991, vol. 7, pp. 244–247.

STECKEL MILL/ON-LINE CONTROLLED COOLING COMBINATION

RELATED APPLICATIONS

This is a continuation-in-part application of (1) U.S. application Ser. No. 09/157,075 filed on Sep. 18, 1998, now abandoned, which is a continuation of U.S. application Ser. No. 08/594,704, filed on Jan. 31, 1996 now issued as U.S. Pat. No. 5,810,951, and (2) U.S. application Ser. No. 09/350,314, filed on Jul. 9, 1999 which is a continuation-in-part application of U.S. application Ser. No. 08/870,470, filed on Jun. 6, 1997 now issued as U.S. Pat. No. 5,924,318.

FIELD OF INVENTION

This invention relates to the in-line combination of a reversing roll mill (herein referred to as a Steckel mill) and its associated coiler furnaces with a flying shear and controlled cooling apparatus downstream of the Steckel mill, and a preferred method of operating same. This combination of equipment and the method of operating same would find their utility as part of a hot steel rolling mill and preferred method of operating same.

BACKGROUND OF THE INVENTION

In an as-hot rolled microalloyed steel, optimum strength and toughness are conferred by a fine-grained polygonal ferrite structure. Additional strengthening is available via precipitation hardening and ferrite work hardening, although these can be detrimental to the fracture properties. The development of a suitable fine-grained structure by thermo-mechanical processing or working such as hot rolling can be considered to occur in three or sometimes four stages or regions. In the first, a fine-grained structure is produced by repeated recrystallization of austenite at high temperatures. This is followed, in the second, by austenite pancaking at intermediate temperatures. The third stage involves working the steel at the still lower temperatures of the intercritical region, i.e. the ferrite/austenite two-phase range. Sometimes, further working below the ferrite/austenite two-phase temperature range can occur. For a given chemistry (alloy composition), the final microstructure is dictated by the amounts of strain applied in each of these temperature ranges and the cooling applied after it leaves the rolling mill.

The first stage occurs at temperatures above temperature $T_{nr}$, being the temperature below which there is little or no austenite recrystallization. The second stage occurs at temperatures below temperature $T_{nr}$ but above the temperature $Ar_3$, being the upper temperature limit below which austenite begins to transform into ferrite. The third stage occurs at temperatures below temperature $Ar_3$ but above the temperature $Ar_1$, being the lower temperature limit below which the austenite-to-polygonal ferrite transformation is complete. The final stage occurs below temperature $Ar_1$. (The designations $Ar_3$ and $Ar_1$ are conventionally used to identify the upper and lower temperature limit respectively of the ferrite/austenite two-phase region, as it exists during cooling.) Since only limited improvement in steel quality normally occurs below temperature $Ar_1$, steel is frequently not rolled below this temperature, although in some cases further such rolling is desirable to further harden the steel albeit at the expense of ductility.

An objective for obtaining superior strength and toughness of steel is to obtain as much fine-grained bainite as possible in the final product. To this end, a specific amount of reduction should occur above the minimum recrystallization temperature $T_{nr}$.

In-line controlled cooling apparatus is previously known for use in rolling mills in which steel progresses in-line from a caster through a series of reduction stands and eventually is reduced to a finished product thickness, cut to length and offloaded. At an appropriate stage downstream of the reduction roll stands, controlled cooling apparatus may be provided that imparts to the rolled steel a relatively rapid cooling intended to consolidate the grain structure that has been obtained during the preceding sequence of reductions of the intermediate steel sheet product. The purpose of the controlled cooling is to cool the rolled intermediate product quickly while still fully austenitic, and more importantly, to promote transformation of austenite to bainite, which possesses attractive combinations of strength and toughness.

A problem with this conventional technology is that the steel undergoing the series of reductions is continuously losing heat and dropping in temperature. Because reduction of the steel, while the temperature of the steel remains above the $T_{nr}$ (the temperature above which recrystallization will occur) imparts fine grain structure to the steel and because the sheet is constantly dropping in temperature, it is desirable to run the steel as rapidly as possible through the series of reduction stands in order to optimize the amount of reduction that can occur above the $T_{nr}$. However, such rapid passage of the steel through the series of reduction stands can have at least some undesirable offsetting counter-effects, including:

1. the absence of sufficient time between sequential passes for the desired amount of recrystallization to occur; and
2. the increased capital expenditure required to provide equipment compatible with high-speed rolling mill operation.

Suitable controlled cooling equipment may comprise water spray devices or laminar flow cooling or a combination of both. While in some situations, an immersion cooling might be appropriate, it is seldom suitable for the production of fine-grain bainite steels that is the objective of the controlled-cooling technology heretofore practised.

A further limitation of a conventional rolling line is that the flow-through capacity is limited by the item of in-line equipment having the smallest flow-through capacity. This is true also of Steckel mill lines, an example of one such being disclosed in U.S. Pat. No. 5,414,923 (Thomas et al.). Such Steckel mill lines typically comprise in downstream sequence: a reheat furnace, a Steckel mill with associated coiler furnaces, a downcoiler (or upcoiler), a cooling station, and a plate table with a shear. Of these items of apparatus, typically the maximum-weight capacity of the downcoiler or coiler furnace is substantially less than other items of apparatus in the line. Therefore, the flow-through capacity of some or most of the items of apparatus is not fully utilized; overall production is limited by one of the items of coiling equipment.

SUMMARY OF THE INVENTION

I have discovered that a superior use of controlled cooling with the objective of obtaining a steel product (coil or plate) characterized by fine-grain-structure bainite can be obtained by appropriately combining controlled cooling with Steckel mill rolling. Steckel mill rolling is inherently slower than in-line sequence reduction rolling, and this slower rolling procedure permits the recrystallization within the steel undergoing processing to occur optimally, whereas in high-speed in-line sequential rolling stand-type steel mills, there may be insufficient time between sequential reductions for the steel to take full advantage of the recrystallization phenomenon.

The conventional wisdom is that the time between sequential reductions has to be kept short because the steel sheet being rolled is constantly losing temperature. However, in a Steckel mill line, this problem is not nearly as acute for at least thinner end products because the Steckel mill is used in conjunction with associated coiler furnaces into which the steel product being rolled can be coiled up following each reduction pass of the product through the Steckel mill. The coiled steel is retained in the coiler furnace, and the coiler furnaces are maintained at a temperature that is typically at least about 1,000° C., a temperature which is above the $T_{nr}$ for most grades of steel of interest. Consequently, the rate of temperature decline of steel product coiled between successive rolling passes is significantly slowed, thereby substantially extending the amount of time available for reductions above $T_{nr}$, and thereby substantially increasing the amount of austenite recrystallization. While the foregoing advantage of Steckel mill operation applies only to strip and plate intermediate products that can be coiled in the coiler furnaces, thicker flat plate products also benefit to a limited extent from Steckel mill rolling, since during rolling they retain heat more persistently than thinner steel, and the inevitable pauses while the Steckel mill decelerates, reverses, and accelerates facilitate controlled recrystallization of the steel being rolled. The foregoing benefit may be further enhanced by installing a heat retention furnace in-line and in the vicinity of the Steckel mill to extend the period of time during which the steel remains above $T_{nr}$, although such auxiliary furnace would add to the complexity and to the capital cost of the installation.

Once the desired number of reductions have occurred in the Steckel mill above the $T_{nr}$, then a further series of reductions at somewhat reduced temperatures can occur so as to "pancake" the fine austenitic grain structure obtained. Immediately after the pancaking sequence of reductions, which will occur below the $T_{nr}$ but above the $Ar_3$, the steel is passed through controlled cooling apparatus so as to obtain a relatively rapid reduction in temperature below the$Ar_3$ for the production of a high proportion (I have obtained more than 90% using the present invention) of optimally conditioned bainite.

According to one aspect of the invention, a Steckel mill and associated upstream and downstream coiler furnaces are combined in-line with a hot flying shear and an accelerated controlled cooling apparatus in sequential order downstream of the Steckel mill. The steel is rolled at temperatures above the $T_{nr}$ for a selected number of rolling passes, so as to achieve a first selected reduction of the steel which is preferably at least about 1.5:1. (The coiler furnaces are maintained at a temperature of at least about the $T_{nr}$, so as to help maintain the temperature of coilable steel above the $T_{nr}$ when such is being rolled.) Thereafter, the steel is rolled below the $T_{nr}$ for a further selected number of rolling passes, so as to achieve a selected second reduction of the steel preferably of the order of 2:1. It can be seen that the combined effect of the first and second reductions is, therefore, an overall reduction of at least about 3:1, which is considered to be the appropriate minimum for the obtention of preferred metallurgical results. The second reduction is completed at an exit temperature from the rolling mill of at least about the $Ar_3$ and acceptably somewhat higher.

After rolling, the steel is at about the $Ar_3$ temperature and is then transferred to a flying shear. The shear cuts a clean transverse face on the leading edge of the steel; such cutting facilitates even cooling of the steel surfaces during downstream controlled cooling (described below). If necessary, the shear may also cut the steel to a suitable length for further downstream processing. If the optional optimization method is applied to the steel (described in detail below), the shear is also used to cut the steel into respective target and surplus portions.

The steel is then subjected in the accelerated controlled cooling apparatus to controlled cooling of about 12° C. to about 20° C. per second, and preferably about 15° C. per second, so as to reduce the temperature of the steel by at least about 200° C. and preferably at least about 250° C. Since the $Ar_3$ for most commercial grades of steel of interest is typically of the order of 800° C. or at least in the range of about 750–800° C., it follows that the exit temperature following the accelerated controlled cooling of the steel product will be no higher than 600° C. and typically no lower than about 450° C., and most probably and preferably in the range of about 470° C. to about 570° C. The temperature drop imparted by the controlled cooling can be more than 250° C. below the $Ar_3$, but should not be more than about 400° C. below the $Ar_3$ and preferably in the range about 250° C. to about 350° C. below the $Ar_3$.

The accelerated controlled cooling apparatus is preferably laminar flow cooling apparatus so far as the upper surface of the steel being processed is concerned; the undersurface of the steel product is preferably cooled by a quasi-laminar spray. The usual spray medium is water, maintained within conventional temperature ranges. Such cooling apparatus is per se previously known and not per se part of the present invention.

The selected amount of the temperature drop from the $Ar_3$ imparted by the accelerated controlled cooling will depend upon the chemistry (alloy composition) of the steel being rolled, in the discretion of the metallurgist who is responsible for the steel processing.

Fine-grain structure in steel is encouraged and enhanced by the presence of columbium (niobium) in the steel alloy composition. With the use of the Steckel mill/controlled cooling combination and method of the present invention, it is possible to reduce the amount of columbium in the steel alloy composition and still achieve a satisfactory fine-grained structure. Other alloying elements that may possibly be reduced in quantity with the assistance of the present invention include molybdenum and manganese.

In addition to providing a metallurgically desirable end-product, the combination of apparatus in the rolling line according to the invention also enables an increase in flow-through capacity of plate in the steel rolling mill. Locating the flying shear immediately downstream of the Steckel mill and coiler furnaces, and upstream of the controlled cooling station, enables the Steckel mill to roll a slab having a weight that exceeds the coiler furnace weight capacity, but not the Steckel mill reduction capacity ("maximum weight slab"). The maximum weight slab according to an optional method of use of the invention is rolled by the Steckel mill to a desired first-rolled thickness, preferably within the coiler furnace thickness capacity, then is severed by the flying shear into a target portion having a weight within the coiler furnace weight capacity, and a surplus portion. The coiler furnace then coils the target portion according to the above described steps, and the surplus portion is either immediately transferred downstream for further processing, or is further rolled by the Steckel mill. Alternatively, a shear may be also located immediately upstream of the Steckel mill to sever the maximum weight slab into respective target and surplus portions. Of course, the shear between the Steckel mill and controlled cooling apparatus is also present to be used for effecting a clean transverse face to the leading edge of the steel, as well as cutting the steel to length as required for downstream processing.

THE DRAWINGS

DETAILED DESCRIPTION WITH REFERENCE TO ACCOMPANYING DRAWINGS

Figure 1:
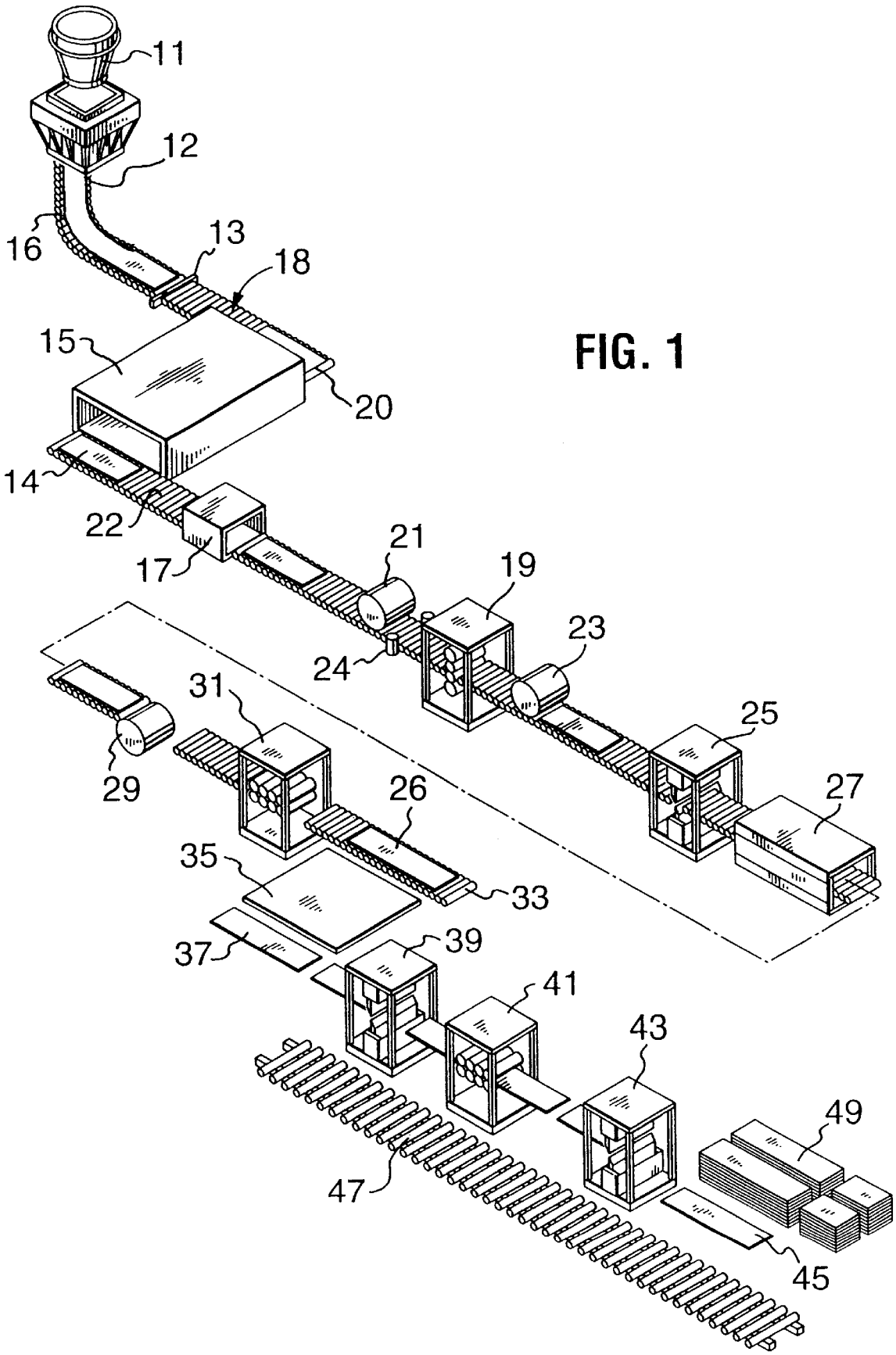
FIG. 1 is a schematic diagram of a steel rolling mill incorporating a Steckel mill, a hot flying shear and an on-line controlled cooling apparatus in accordance with the principles of the present invention.

Referring to FIG. 1, molten steel is supplied to a caster 11 that produces a cast steel strand 12 that is cut to length by a torch 13 located at the exit of the cast strand containment and redirection station 16 thereby to produce a series of cast slabs 14.

At the terminating end of the caster runout table 18 is a transfer table 20 that transversely feeds the slabs 14 sequentially into reheat furnace 15 where they are brought up to a uniform temperature for rolling. Optionally, the slabs may be fed into a quench station [not shown] located closely downstream of the caster 11 and upstream of the reheat furnace 15. The quench station applies a rapid cooling to the steel thereby transforming selected surface layers of the steel from austenite into non-austenitic microconstituents. It has been found reheating the steel in the reheat furnace 15 re-transforms the surface layers into fine-grained austenite which tends to reduce or altogether eliminate the occurrence of surface defects in the steel. The apparatus and method for quenching such steel is disclosed in patent application Ser. No. 09/113,428.

At the exit of reheat furnace 15, the slabs 14 are transferred to the upstream end of a rolling table 22. The slabs are descaled in a descaler 17 and then reversibly rolled in a Steckel mill 19 provided with the usual upstream and downstream coiler furnaces 21, 23. An edger 24 squeezes the side edges of the intermediate rolled product for dimensional control. If the weight of a slab exceeds the weight capacity of the coiler furnaces 21, 23, (or some other applicable limiting flow through parameter, to be discussed in detail below) the slab is severed by hot flying shear 25 into a target portion within the coiler furnace weight capacity and a surplus portion. Preferably the target portion is severed after it has been reduced to a thickness within the coiler furnace thickness capacity, but if not, it is then further reduced until its thickness is within the coiler furnace thickness capacity. Then the target portion is coiled in one of coiler furnaces 21, 23 while the surplus portion can be further reduced by the Steckel mill, or immediately sent downstream for further processing.

In accordance with the invention, Steckel mill 19 is used in conjunction with its associated coiler furnaces 21, 23 to maintain the intermediate steel product undergoing processing at an adequately high rolling temperature. In the reversing rolling sequence through the Steckel mill 19, during an austenite recrystallization stage, the slab is first flat-passed rolled into an intermediate steel product at a temperature above $T_{nr}$ in order to provide controlled austenite recrystallization of the steel. Then, if the steel is coilable within the coiler furnaces 21, 23 the steel product is subjected to at least one recrystallization coiler-pass comprising reducing the steel to a thickness within the upper limit (say, of the order of about 1") of steel thickness coilable by the coiler furnace (coiler furnace thickness limitation), and coiling the steel product within the coiler furnaces 21, 23. The coiler furnaces 21, 23 are maintained at least about 1,000° C., which is for steel grades of interest, above the $T_{nr}$. The coiler furnaces 21, 23 substantially slow the natural (slow-air) cooling rate of the coiled product, so that the product remains above $T_{nr}$ for the selected number of recrystallization coiler passes. This rolling sequence above the $T_{nr}$ will achieve a fine-grained austenite structure of the steel undergoing sequential reductions.

During the recrystallization coiler passes, the steel product is reduced to a desired interim-rolled thickness, say, one-third of the initial slab thickness. There is ample opportunity for the steel to undergo recrystallization during both flat and recrystallization coiler passes: during the flat passes, the slower speed of a Steckel mill relative to conventional sequential in-line rolling stands affords the steel sufficient time to take optimum advantage of the recrystallization phenomenon between sequential reductions above temperature $T_{nr}$. During the recrystallization coiler passes, the period of time taken to coil the steel, slow the coiling to a stop, reverse coiling direction, then uncoil the steel provides additional time for recrystallization (all of these steps occurring within a coiler furnace maintained above temperature $T_{nr}$). Preferably, the total recrystallization period should be at least about 60 seconds for most steels of interest. However, the desired recrystallization period may vary somewhat for different steel chemistries.

It has been found that for most steels of interest, no deliberate pause periods need to be added to the above steps to achieve the desired recrystallization period, even for reductions limited to flat-pass rolling. However, should providing a deliberate pause be desired, such a pause can be added to the rolling schedule during the coiler passes, e.g. by holding the product inside the coiler furnace for an extended period of time before uncoiling.

While adding pauses to extend the total recrystallization period, i.e. the total period of time at which the steel remains above $T_{nr,}$ desirably increases the time for austenite recrystallization, the increased rolling time also provides additional opportunity for certain precipitates to come out of solution in the steel. For example, during the recrystallization stage of a niobium (Nb) micro-alloyed steel, the solubility of Nb in solid solution is exceeded at around 900–1000° C. and Nb(C,N) begins to precipitate from the matrix. These precipitates particularly form on austenite grain boundaries and promote desirable pancaking of the austenite structure. However, it is also desirable to maintain a certain amount of Nb in the solution during rolling, as the Nb serves to retard the austenite-to-ferrite transformation, thereby promoting the formation of fine-grained acicular microstructures, and, the Nb will precipitate in the ferrite during or after transformation thereby providing further strength to the steel. Therefore, the desired proportion of Nb precipitation is dependent in part on the desired properties of the steel and can be controlled to some extent by choosing the length of the recrystallization period. While Nb has been used as an example, similar behaviour is also seen in other alloying elements, such as titanium and vanadium.

In choosing the recrystallization period, the operator will balance these different and not-necessarily complementary interests, such as choosing between obtaining enhanced austenite recrystallization, and obtaining benefits associated with keeping a selected amount of alloying elements in solution for a relatively long period of time during reduction rolling.

Once the steel product has been reduction rolled to the interim thickness above the $T_{nr}$ and sufficient recrystallization has occurred, the steel product enters a pancaking stage during which its temperature falls below $T_{nr}$. If the steel is coilable within the coiler furnaces 21, 23, the rate of temperature drop can be reduced as a further series of coiler passes through the Steckel mill occurs, during which the fine grain structure achieved is "pancaked" and consolidated. The coiler passes during the pancaking stage are hereinafter referred to as pancaking coiler passes to distinguish them from the recrystallization coiler passes. Over the period of time taken by a predetermined series of pancaking coiler passes, the temperature is permitted to drop from the $T_{nr}$ to the Ar3 at which time the steel product should have reached its target end-product thickness. Although a reduction of as much as 75% between the $T_{nr}$ and the $Ar_3$ can be tolerated, it is preferred that the end-product thickness be about one-half the thickness of the first-rolled thickness of the intermediate steel product at the time it begins to drop below the$T_{nr}$. In other words, the "pancaking" rolling between the $T_{nr}$ and the $Ar_3$ would preferably result in a 2:1 reduction from the first-rolled thickness of the intermediate steel product to the end-product thickness.

In certain situations, it may be desirable to further slow the rate of temperature decline of the steel during one or both the recrystallization and pancaking stages. To this end, heat-retention furnaces may be installed at an appropriate location in the vicinity of the Steckel mill, such as an electromagnetic induction furnace (not shown) installed in-line and immediately upstream of the Steckel mill. Such an induction furnace is preferably wide and long enough to accommodate the respective widths and lengths of all slabs of interest, and operable at above the $T_{nr}$ so that sufficient heat may be applied to the flat-passed slabs to facilitate sufficient austenite recrystallization.

The induction furnace may be used to slow the rate of temperature decline of the steel independently of the coiler furnaces. For example, the cooling rate of steel flat passed without coiling in the coiler furnace can be slowed by passing the steel through the induction furnace between successive flat-passes, or holding the steel in the induction furnace for a pause period between successive flat-passes.

Preferred metallurgical practice dictates that the overall reduction in the rolling mill should be at least about 3:1. Accordingly, if the reduction imparted below the $T_{nr}$ is about 2:1 (i.e. from the interim-rolled thickness to the end-target thickness), then it follows that the reduction above the $T_{nr}$ should be at least about 1.5:1 (i.e. from the initial slab thickness to the interim-rolled thickness). The amount of reduction, of course, will depend in large measure upon the ratio of the end-product thickness (determined by the customer's order) and the initial slab thickness (typically fixed for a given rolling mill). If, for example, the end-product thickness is to be 0.5", then preferably the intermediate steel product is rolled below the $T_{nr}$ from an interim-rolled thickness of about 1.0" to a thickness of 0.5" to reach a rolling completion temperature of about the $Ar_3$. If the initial slab thickness is 6", it follows that a 6:1 reduction must occur above the $T_{nr}$ in order to generate an intermediate product of interim-rolled thickness of 1.0" that can be rolled between the $T_{nr}$ and the $Ar_3$ to the desired 0.5" end-product thickness.

Coiler furnaces based on present technology can typically coil steel slabs having thicknesses up to 1.0", although in some cases, steel product having thicknesses of up to 1¼" may be coiled. Given that the desired reduction from the interim-rolled thickness to the end-product thickness is 2:1 (in the pancaking stage where the product temperature is between $T_{nr}$ and $Ar_3$), it follows then that the maximum end-product thickness that can be obtained is 0.5". To obtain steel products with a thicker end-product thickness, the product is rolled to a thicker intermediate product which may be too thick to for coiling in the coiler furnaces. If so, the product is flat-pass rolled only at one or both of the recrystallization and pancaking stages, i.e. without any recrystallization coiler passes or pancaking coiler passes. For example, if an end-product thickness of 0.75" is desired, a 2:1 reduction requires the interim-rolled thickness to be around 1.5". Assuming a maximum coilable thickness of 1" of the coiler furnaces, this reduction is performed entirely by flat-passing. As the product enters into the pancaking stage, i.e. falls below $T_{nr}$ the product is further flat passed until it reaches the target end-product thickness. Should the end-product thickness be within the coiler furnace thickness limitation, it is possible to subject the product to at least one coiler pass. Trade-offs may have to be made between the need for available longitudinal line space for flat-pass rolling and the objective of rolling high-quality steel to the maximum capacity of the mill. To facilitate flat-pass rolling of plate without undergoing undue temperature decline, the optional induction furnaces described above are used to slow the rate of natural cooling of the product.

Once the intermediate rolled product (or target portion or surplus portion if the product has been severed during the rolling step) has reached an appropriate end-product thickness, its leading and trailing ends are cut off by the hot flying shear 25. The leading end is preferably cut so that it has a clean transverse vertical face with as uniform a surface as possible to facilitate even cooling of the top and bottom surfaces of the product when the product is subjected to downstream forced cooling in controlled cooling apparatus 27 (described in detail below). Processing upstream of the rolling mill can produce a leading edge having an irregular shape. A steel product having such a irregularly shaped leading edge has been found to be difficult to cool evenly in the controlled cooling apparatus 27; the extreme leading portion of the non-uniform leading edge will transform first as a result of the cooling, introducing an uneven metallurgical transformation throughout the steel, or perhaps initiating conditions of "porpoising" in the steel and aggravating edge ripple through the steel, in both the vertical and transverse dimensions. Upwardly or sideways turned edges can affect the quality of finished steel product.

The hot flying shear 25 has been found to be capable of cutting a suitably precise and clean vertical transverse edge so that such uneven cooling is avoided. Hot flying shear 25 is preferably a drum-type rotary shear or the sort suitable for cropping strip and pre-dividing plates. Such shears typically are capable of exerting a maximum shearing force of about 2,250,000 lbs (10,000 kN) at a speed of about 400 FPM (2.03 m/s).

Coiling the steel product in the coiler furnaces 21 produces the added benefit of temperature uniformity along the length of the steel when it is subjected to controlled cooling. The heat applied to the steel in the coiler furnace 21 tends to reduce any lengthwise temperature variation that previously developed in the steel. The relatively close proximity of the coiler furnace 21 to the controlled cooling apparatus 27 does not allow an appreciable temperature gradient to form along the length of the steel after it has been played out of the coiler furnace 21 and fed into the cooling apparatus 27.

The flying shear 25 may also be used to cut the product 26 to length (as separate from cutting the product to a target and surplus portion according to the optimization method described below). Once cut, the upstream product portion is accelerated away from the downstream portion to create a suitable distance between the two portions. In some cases, such speed changes may cause longitudinal temperature variations along the steel product when it is subjected to forced cooling in the controlled cooling station described in detail below. Such temperature variations if sufficiently severe tend to result in an inferior end product having inconsistent metallurgical and physical properties.

To avoid the onset of unacceptable longitudinal temperature variations, the location of the controlled cooling station 27 can be extended further downstream to allow the product to reach a steady speed before being forcibly cooled; however, such lengthening is usually expensive and impractical given the limited space in the mill. Alternatively, cutting to length may be effected by a separate flying shear ("downstream flying shear", not shown) located downstream from the controlled cooling station 27. However, a second flying shear will also be costly. Therefore, the product may be cut to length by the upstream flying shear 25 and a certain amount of temperature variation may be tolerated; in this connection the operator will be mindful to keep the acceleration of the leading portion to a minimum.

In accordance with an aspect of the invention, on-line controlled cooling is provided by an on-line controlled cooling apparatus 27 downstream of hot flying shear 25 that is in turn downstream of the Steckel mill 19. The arrangement is shown in greater detail in FIG. 2, which illustrates the downstream coiler furnace 23 but omits the upstream coiler furnace 21 for drawing simplicity and clarity. After rolling, the steel enters a cooling stage during which it is passed through the on-line controlled cooling apparatus 27 with an entry temperature at about the $Ar_3$ and with an exit temperature substantially below that—a temperature drop of at least about 200° C. and preferably at least about 250° C. should occur, with a cooling rate of about 12°–20° C. per second and preferably of the order of about 15° C. per second, depending upon the thickness of the final plate product. Since the $Ar_3$ for most commercial grades of steel of interest is typically of the order of 800° C. or at least in the range of about 750°–800° C., it follows that the exit temperature following the accelerated controlled cooling of the steel product will be no higher than 600° C. and typically no lower than about 450° C., and most probably and preferably in the range of about 470° C. to about 570° C. The temperature drop imparted by the controlled cooling can be more than 250° C. below the $Ar_3$, but should not be more than about 400° C. below the $Ar_3$ and preferably in the range about 250° C. to about 350° C. below the $Ar_3$.

It can be seen that the on-line controlled cooling station 27 includes an upper array 51 of laminar flow cooling devices that provide cooling water to the upper surface of the intermediate steel product 61 passing underneath the upper array 51. At the same time, a lower array 53 of spray cooling devices provide a cooling spray to the undersurface of the intermediate steel product 61 passing above the array 53.

Figure 3:
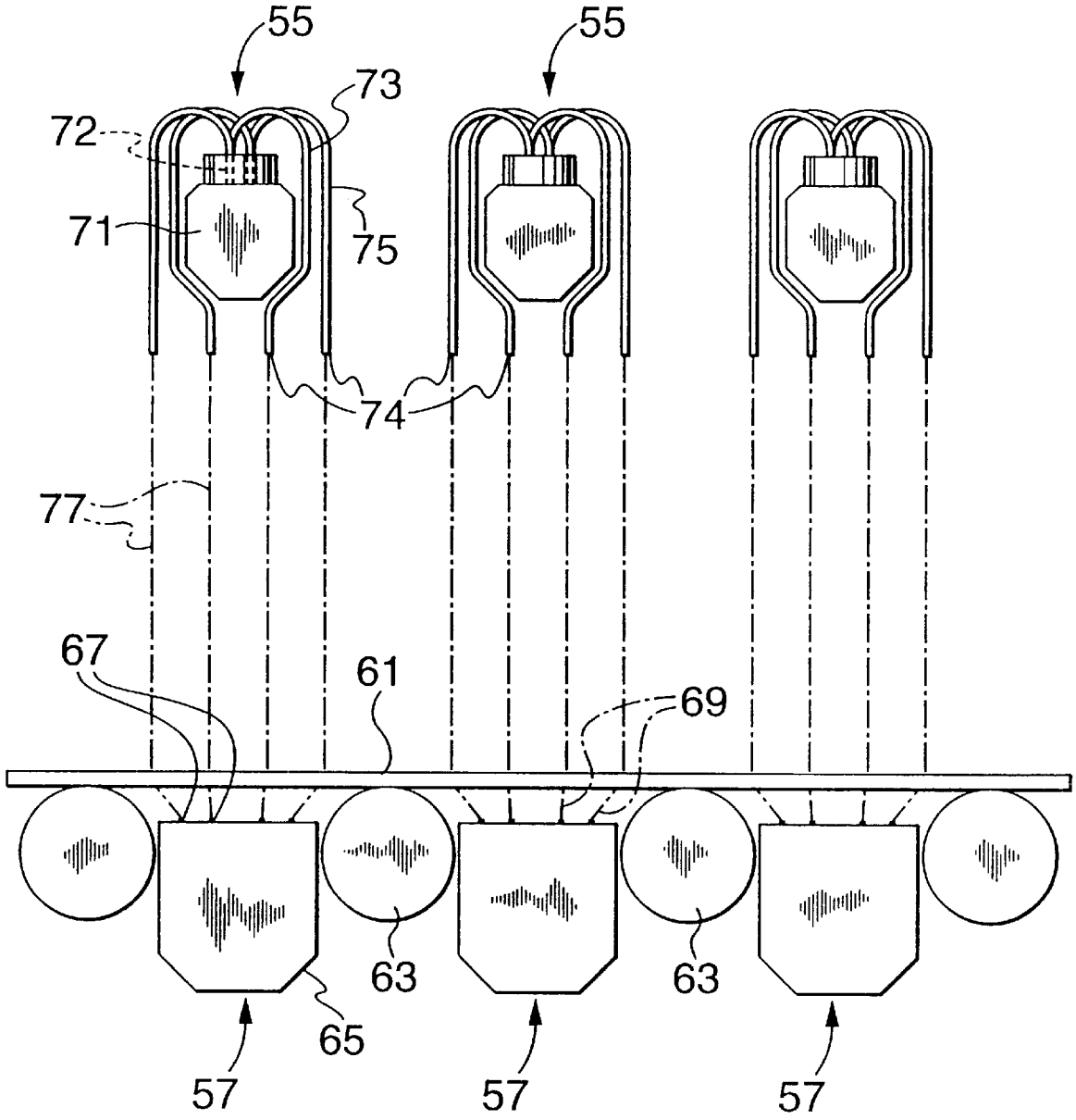
FIG. 3 is a schematic diagram of a portion of the on-line controlled cooling apparatus of FIG. 2 showing the cooling spray devices and nozzles in greater detail.

The upper array 51 comprises a longitudinally arranged series of cooling nozzle groups or banks 55 that are more clearly presented in FIG. 3. It can be seen that each individual transversely arrayed bank is supplied by a transverse water supply header 71 providing water to a transversely spaced series of inner laminar flow nozzle elements 73 and outer laminar flow nozzle elements 75. It can be seen from FIG. 3 that these nozzle elements 73, 75 are connected at their inner ends 72 to the water supply header 71 from which they obtain a continuous supply of water. The water flows in a series of four laminar rows 77 from each laminar flow bank 55, the rows of water 77 flowing out of the open-end 74 of the nozzle elements 73, 75 and onto the upper surface of the intermediate steel product 61 passing underneath the laminar flow nozzle banks 55.

On the underside of the intermediate steel product 61, cooling water sprays 69 are ejected from outlet ports or nozzles 67 both longitudinally and transversely spaced along the upper surfaces of spray headers 57 that supply the nozzles 67. The headers 57 are themselves longitudinally spaced from one another and interposed between a longitudinal series of transversely extending table rolls 63 that support and drive the intermediate steel product 61. The nozzles 67 are preferably arranged to provide quasi-laminar cooling. They may be, for example, of the design of the Mannesmann DeMag controlled controlled cooling facility installed in or about 1990 at the Rautaruukki Steel Mill in Finland.

Figure 2:
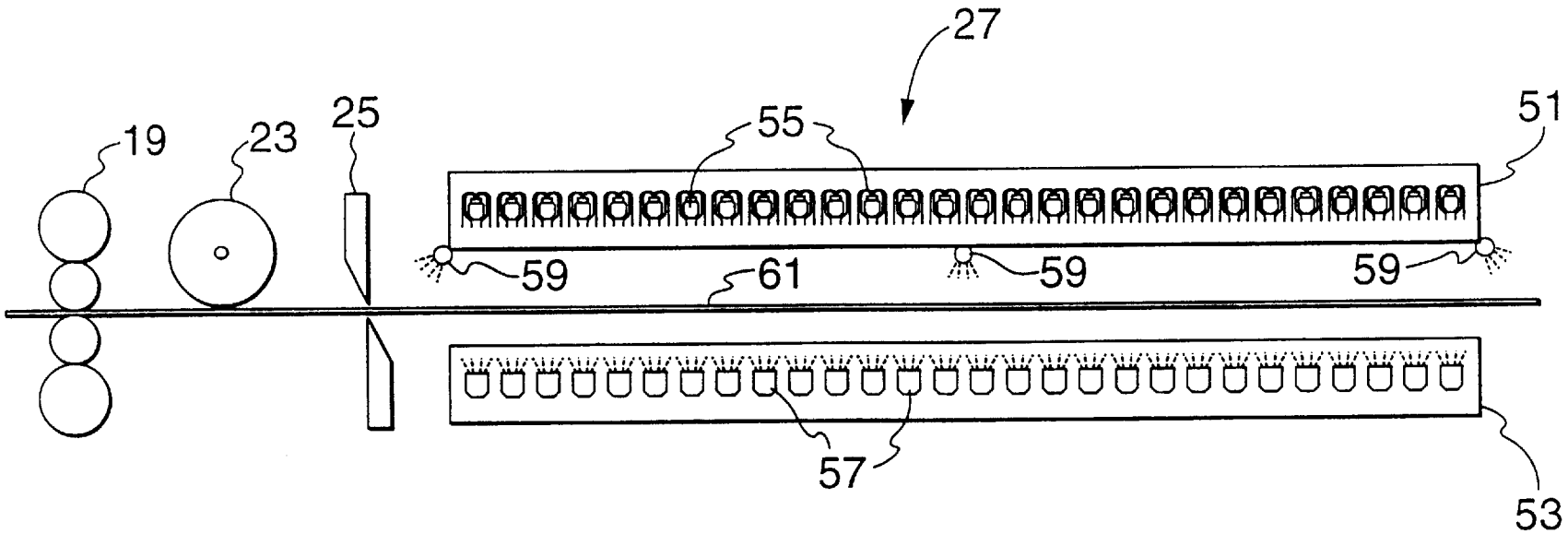
FIG. 2 is a schematic diagram of the Steckel mill, shear and on-line controlled cooling apparatus of FIG. 1 showing the on-line controlled cooling apparatus in greater detail.

Although the controlled controlled cooling apparatus is illustrated in FIG. 2 as constituting a single extended array of cooling nozzles, it may be desirable to divide the accelerated controlled cooling apparatus longitudinally into a series of separated banks, each bank being individually selectably operable to provide cooling water or to be shut off. Such latter arrangement would facilitate a controlled reduction in the amount of water applied to the rolling of thinner steel products which, in turn, would facilitate the maintaining of the rate of cooling at about the 15° C.-per-second preferred cooling rate.

Preferably, the controlled cooling apparatus 27 also includes two overhead tanks (not shown) of approximately 2100 $ft^3$ capacity each, control valves (not shown), and a main distribution pipe and connection pipes to cooling headers (not shown). Such an arrangement enables the controlled cooling apparatus 27 to emit from its top cooling banks 55 and bottom nozzles 67 an approximate maximum water flow of about 52,900 GPM (12,000 $m^3$/hr). A controlled cooling apparatus 27 capable of delivering this maximum flow rate is operable to cool an incoming steel product at the desired cooling rate and to the desired exit temperature as discussed above. Specific flow rates for a given steel product thickness and its given associated cooling rate can be empirically determined by selecting a given flow rate then measuring a test slab cooled by the cooling apparatus 27 to determine whether the selected flow rate effects the desired cooling rate and/or structure.

Wipe nozzles 59 of conventional design remove surplus water from the upper surface of the intermediate steel product 61.

The downstream processing following controlled cooling in the controlled cooling station 27 may include optional hot-levelling in hot leveller 31 of the intermediate plate product 26 which then passes to a transfer table 33 and thence transversely to a cooling bed 35.

At the exit end of the cooling bed 35, heavier intermediate plate product passes from a transfer table 37 thence to a static shear 39, where it is cut to length. The intermediate product passes thence to a cold-leveller station 41 for further levelling. Lighter product is finally cut to length and/or trimmed by a flying shear 43. The plate end-product 45 may be passed to transfer tables 47 for shipment or piled in piles 49.

Note that for plate production, there is a trade-off between optimum steel conditioning in the controlled cooling apparatus 27 and optimum conditioning in the following hot leveller 31. For optimum hot-levelling, the entry temperature of the steel plate is preferably closer to the $Ar_3$ than is desirable for the exit temperature of the plate as it leaves the controlled cooling apparatus 27. So the on-line controlled cooling treatment may be selected to be something less than optimum, leaving the steel plate at a higher than optimum exit temperature as it leaves the controlled cooling apparatus 27, or else the plate may be given closer to optimum treatment at the controlled cooling apparatus 27 in which case its entry temperature at the hot-leveller 31 will be lower than would be optimum for the hot-levelling treatment. The trade-off in any given production situation will depend upon the order book and the customer's requirements for the steel product being produced.

If the combination of Steckel mill processing and controlled cooling is practised as proposed herein, then the amount of columbium (niobium) used to promote preferred fine grain structure could be reduced in comparison with what is normally expected using conventional processing of similar grades of steel. The extent of the possible or preferred reduction in columbium will depend upon the customer's steel specifications.

The amounts required of other alloying elements such as molybdenum and manganese frequently found in higher grade steel may possibly also be decreased in accordance with the present invention by reason of the obtention of a high-strength steel product without the need for relatively high quantities of alloying elements such as the foregoing.

Figure 4:
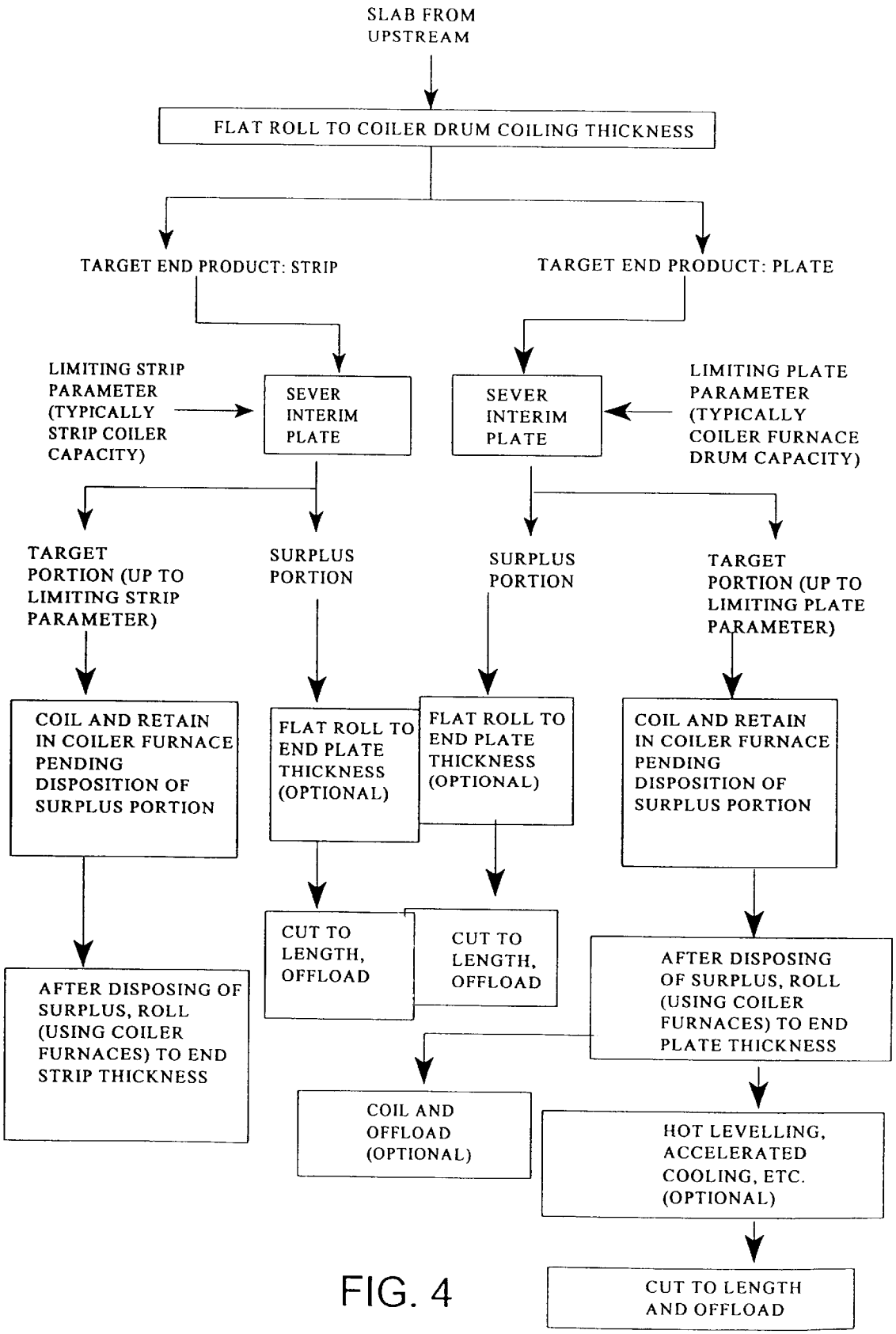
FIG. 4 is a flowchart indicating a preferred sequence of operations for optimizing the efficiency of a rolling mill in accordance with the principles of the present invention.

The above described method is constrained to processing slabs that do not exceed the applicable maximum flow-through parameter of the rolling mill. Typically, the maximum weight of the slab is limited by the apparatus having the smallest weight capacity amongst the combination of apparatus described above ("limiting apparatus"). For slabs that are coiled in the coiler furnaces 21 and eventually processed into discrete plate, the applicable limiting flow-through parameter is the weight capacity of the coiler furnaces 21, 23, which is typically around 75 tons. By carrying out a series of additional optional steps to the above process, a slab exceeding the capacity of the limiting apparatus may be processed ("maximum weight slab"), thereby increasing the flow-through capacity of the rolling mill. This is discussed in detail in U.S. Pat. No. 5,924,318, is illustrated in FIG. 4, and is summarized below.

The weight of the maximum-weight slab to be rolled is typically limited by the maximum dimensions of the slab that can be reheated in the reheat furnace 15, which can typically handle slabs of 6" thickness, 120" width, and 75' length. Such slabs of maximum dimensions weigh approximately 92 tons. While the Steckel mill 19 can be built to be capable of rolling such maximum weight slabs, the weight capacity of the coiler furnaces is typically exceeded. Therefore, the maximum weight slab is severed into portions prior to coiling in the coiler furnace 21, 23, wherein the weight of the portion to be coiled (the target portion) is within the coiler furnace weight capacity.

The severing of the slab into respective target and surplus portions is preferably made by the flying shear 25 located between the Steckel mill 19 and the controlled cooling station 27. Present-day suitable flying shears typically can sever slabs up to about 2 inches in thickness. In this connection, a maximum weight slab thicker than the thickness capacity of the shear is first reduction rolled from a pre-rolled thickness by the Steckel mill 19 to an interim steel product of a severable thickness, then is severed by the flying shear 25 into the target portion and the surplus portion.

If this optional optimization method is employed along with the controlled rolling and cooling steps of the invention previously described, it can be seen that flying shear 25 serves a number of functions, including severing the maximum weight slab into surplus and target portions, effecting a clean transverse face necessary for effective controlled cooling, and cutting the steel to suitable lengths for further downstream processing. It is possible to install another shear ["optimization shear" not shown], of a design similar to that of shear 25, upstream of the Steckel mill [not shown] to sever the maximum weight slab into surplus and target portions, but as installing such a new shear adds extra cost, this alternative is not preferred.

When producing plate intended for coiling in the coiler furnaces, the maximum-weight slab is preferably reduction rolled to below the coiler furnace thickness capacity before it is severed by the flying shear 25. The target portion is then coiled by one of the coiler furnaces 21, 23, and kept above $T_{nr}$ for a selected period of time in accordance with the previously described steps of the method. The surplus portion is then further reversingly rolled in the Steckel mill 19 to reduce its thickness to a desired end-product thickness, or is transferred downstream immediately for further processing.

Should the surplus portion be flat passed in the Steckel mill, the target portion is held out of the way in the coiler furnace 21, 23 for the period, and enjoys substantial austenite recyrstallization before it is uncoiled and is processed according to the method described above.

Figure 5:
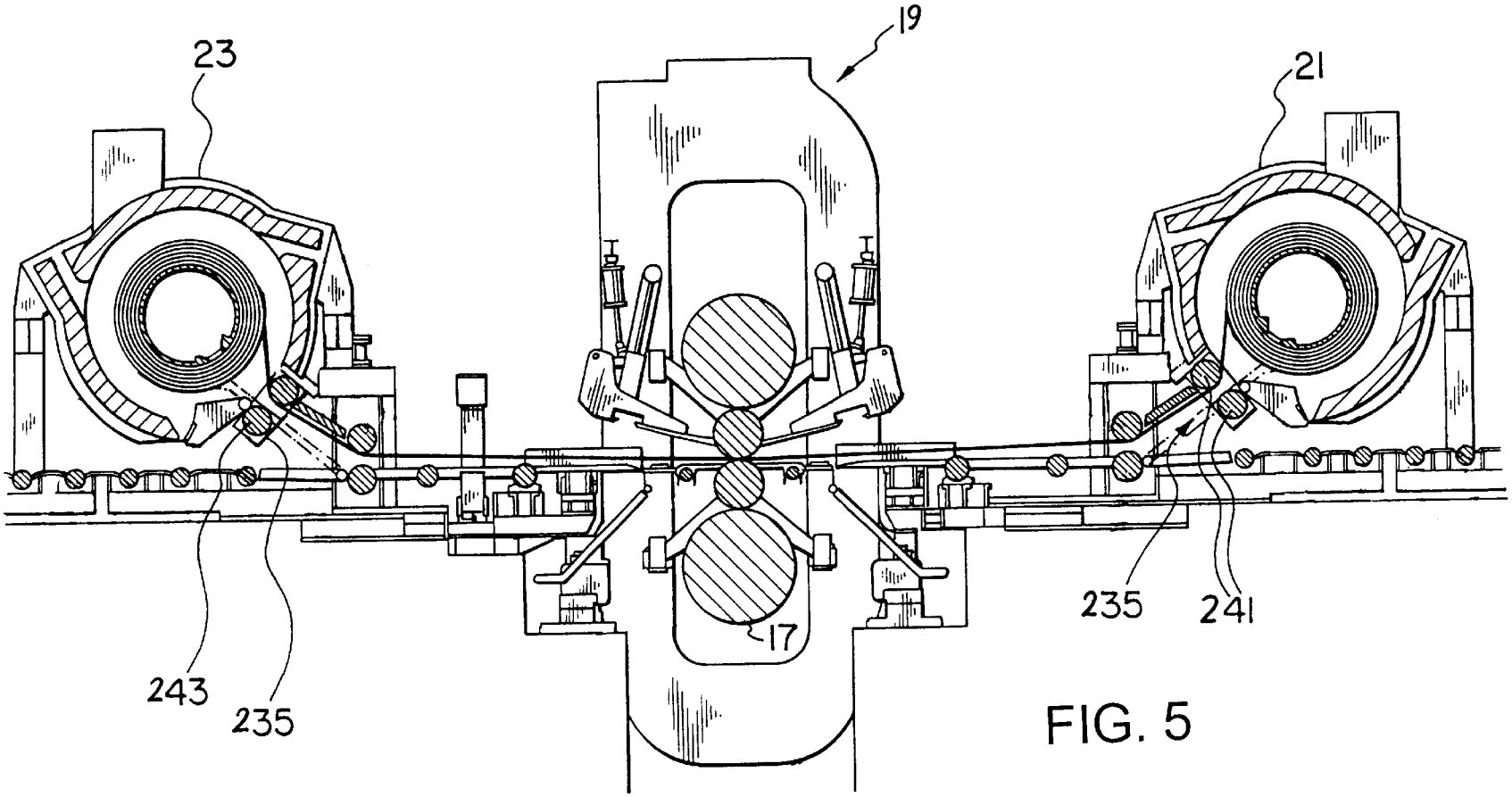
FIG. 5 is schematic diagram of a Steckel mill with associated upstream and downstream coiler furnaces and pinch rolls.

In order for the surplus portion to be reversingly rolled in the above manner, the target portion that is temporarily stored within one of the coiler furnaces 21, 23 cannot protrude outside the mouth of the coiler furnace 21, 23 to an extent that would cause interference with the surplus portion during rolling. Referring to FIG. 5, the use of an auxiliary set of pinch rolls 241, 243 within the mouth each of the coiler furnaces 21, 23, as proposed in the Smith U.S. Pat. No. 5,637,249, facilitates the retraction of the intermediate product within the coiler furnace 21, 23 to an extent much greater than was previously possible using a conventional coiler furnace, and consequently the use of such auxiliary pinch rolls may be necessary or highly desirable in order that the foregoing alternative mode of operation be practised to advantage. Obviously, the foregoing procedure cannot be practised if the tongue of steel sheet hanging out of the coiler furnace mouth 235 is in the path of travel of the residual portion of the steel being flat-passed within the Steckel mill.

The objective of obtaining a final high-quality plate product by means of an economical sequence of steps in a mill provided with a cost-effective selection of equipment is satisfied by the present invention. The plate flow-through capacity is typically determined by the coiler furnace weight capacity. However, according to another aspect of the invention, at least part of the slab may be reduced to strip thickness for coiling on a downcoiler 29. This is illustrated in the left column of the flowchart in FIG. 4. The slab is reduced to a thickness not exceeding the coiler furnace thickness capacity and strip downcoiler 29 thickness capacity, it is severed into a target portion of a weight not exceeding the strip downcoiler weight capacity, and a surplus portion. The surplus portion may be sent immediately downstream to be further processed as a flat plate product, or alternatively, the surplus portion may be further reduction rolled while the target portion yet to be rolled is held in the coiler furnace (assuming the target portion thickness is less than the coiler furnace thickness capacity).

As a further alternative, one or both of the severed slab portions could be made into coiled plate product.

If desired, the benefit of processing a maximum weight slab may be obtained independently of other advantages described in this method. For example, a maximum-weight slab may be severed into target and surplus portions wherein the target portion is coiled in a downcoiler as coiled plate and the surplus portion is sent directly downstream for finishing. In this case, the surplus portion is not necessarily subjected to controlled cooling, in order that the target portion be further processed as quickly as possible. In such case, the surplus portion will not obtain optimal bainite microstructure. However, the benefit of increased flow-through capacity is still achieved.

It is possible to roll the slab to an interim thickness exceeding the coiler furnace thickness capacity (but of course within a thickness severable by the shear), sever into target and surplus portions, reduction roll the target portion to within the coiler furnace thickness capacity while holding the surplus portion away from the rolling activity, coil the target portion in the coiler furnace 21, 23, then if desired, further reduction roll the surplus portion before transmitting it downstream for further processing into a surplus end product, or, if the surplus portion is already at the desired end product thickness, then transmit it immediately downstream for further processing. This alternative step may be desirable if the thickness of the surplus portion is desired to be thicker than the coiler furnace thickness capacity. However, since it is generally desirable to maintain the steel at preferred rolling temperatures, and because of the inevitable space limitations within the steel plant, it is generally preferable to reduction roll the maximum weight slab to a thickness within the coiler furnace capacity before it is severed by the flying shear 25.

If the surplus portion is to be further rolled, its elevated temperature can be maintained, or at least its cooling rate can be dramatically slowed, by placing it inside the heat-retention furnace. As the heat-retention furnace in the embodiment is located in-line and upstream of the Steckel mill, then the rotational direction of the rolls is reversed to move the surplus portion up-line past the flying shear 25, the Steckel mill 19 and into the heat-retention furnace. To facilitate this, the target portion must be moved out of the way by removing it from the line, e.g. if it has been reduction rolled to the desired end-product thickness and is ready to be transported downstream for further processing. Or, the target portion can be coiled in the coiler furnace and held out of the way while the rolls transmit the surplus portion upstream and through the Steckel mill. Of course, if the steel product was initially severed at a thickness exceeding the coiler furnace thickness capacity, then the surplus will have to be held stationary on the line (downstream of the Steckel mill) while the target portion is suitably reduced by the Steckel mill and coiled in the coiler furnace.

After the surplus portion is placed inside the heat-retention furnace, the target portion can be uncoiled for further flat rolling if necessary, e.g. for further pancaking the austenite microstructure and eventual transmittal to the controlled cooling apparatus for cooling. After the Steckel mill has been freed up, then the surplus portion can be further rolled.

EXAMPLE

An exemplary application of the invention to prepare ½" 80,000 PSI yield-strength steel plate begins with a 6" slab of the following chemistry:

| | |
|---|---|
| carbon | 0.03 to 0.05% |
| manganese | 1.40 to 1.60% |
| sulphur | 0.005% max |
| phosphorus | 0.015% max |
| silicon | 0.20 to 0.25% |
| copper | 0.45% max |
| chromium | 0.12% max |
| columbian (niobium) | 0.02 to 0.06% |
| molybdenum | 0.18% to 0.22% |
| tin | 0.03% |
| aluminum | 0.02 to 0.04% |
| titanium | 0.018% to 0.020% |
| nitrogen | 0.010% max |
| vanadium | up to 0.08%. |

After casting, the slab is sent to a reheat furnace with an entry temperature of about 800° C. or slightly below and with an exit temperature preferably about 1,260° C.

The slab is then sent to the Steckel mill for reverse rolling according to the following rolling schedule:

| | Temperature | Thickness |
|---|---|---|
| Slab Dropout | 1,260° C. | 6.0" (152.4 mm) |
| | 1,230° C. | 4.7" (119.4 mm) |
| | 1,200° C. | 3.5" (88.9 mm) |
| | 1,165° C. | 2.4" (61.0 mm) |
| | 1,100° C. | 1.6" (40.6 mm) |
| | 1,050° C. | 1.0" (25.4 mm) |
| | COIL in Coiler Furnace | |
| $T_{nr}$ (Non-Recrys.) | 970° C. | |
| | 950° C. | 0.76" (19.0 mm) |
| | 875° C. | 0.61" (15.5 mm) |
| | 800° C. | 0.50" (12.7 mm) |
| $Ar_3$ (Upper Critical) | 800° C. | 0.50" (12.7 mm) |

In the above table, for steel of the chemistry indicated, the $T_{nr}$ is approximately 970° C. During the recrystallization stage, the steel product is reduced by a series of flat passes according to the above rolling schedule from the reheat furnace dropout temperature of 1,260° C. to 1,050° C. After the flat passes, the steel product in a single recrystallization coiler pass is reduced to the interim thickness of 1.0" and coiled in one of the coiler furnaces. Both coiler furnaces are maintained at an interior furnace temperature of 1,000° C. (but at least 970° C.) to prevent the steel being rolled from dropping in temperature below the $T_{nr}$ before being reduced to the selected interim thickness.

The steel product preferably stays in the coiler furnace for a period above $T_{nr}$ that in combination with the flat passes at above $T_{nr}$ totals at least 60 seconds. While the above rolling schedule has only one recrystallization coiler pass, it is also acceptable to have multiple recrystallization coiler passes, so long as the total time spent above $T_{nr}$ is at least 60 seconds (or such other period as is suitable to the chemistry of the steel being rolled). However, it is preferable to have only one coiler pass, as this permits the Steckel mill to process another slab (surplus portion) while the first slab (target portion) is held out of the way in the coiler furnace, in accordance with the as-discussed optional optimization method.

Once the temperature of the intermediate steel product has fallen to $T_{nr}$, it enters the pancaking stage where it is rolled in a series of pancaking coiler passes between $T_{nr}$ and the $Ar_3$, (800° C. in the above example). During the pancaking stage, the first-rolled thickness of 1.0" at about the $T_{nr}$, (which should still be effective for achieving some degree of recrystallization,) is successively reduced. Note that rolling below the $T_{nr}$ will not admit of any further recrystallization, but instead the next rolling sequence pancakes or flattens the crystal structure previously obtained. In this example, the initial 1.0" thickness obtained from rolling at the $T_{nr}$ is reduced by 50% to an end-product thickness 0.50" at the $Ar_3$. This 2:1 reduction in thickness from the $T_{nr}$ thickness to the $Ar_3$ thickness is representative, and tends to generate a preferred degree of pancaking of the fine crystal structure that had been obtained in the austenite (that is, in accordance with the procedure described, transformed predominantly into bainite).

In the above discussion, the assumption has been made that the $T_{nr}$ and the $Ar_3$ can be accurately determined for a given steel product. However, different and somewhat competing approaches to the determination of these critical temperatures are discussed in the technical literature. Depending upon the equations used, the calculated $Ar_3$ (for example) computed according to a given method may differ by as much as about 10° C. from the calculation of the $Ar_3$ using one of the competing methods of calculation. The present invention is not predicated upon any particular selection of method of calculation of the $T_{nr}$ or $Ar_3$. A 10° variation at either end of a stated range of temperatures is equally considered not to be material to the practice of the present invention. In any given plant, the metallurgist or the person responsible for mill operation will undoubtedly evaluate rolling and cooling results empirically, and choose a combination of rolling and cooling parameters that appears to give optimum or near-optimum results. However, optimum or near-optimum results should be obtainable with a minimum of empirical adjustment using the combination and methods described and claimed in the present application.

Variations in what has been described and illustrated in this specification will readily occur to those skilled in the technology. The invention is not to be limited by the specific example and description above; the scope of the invention is as defined in the accompanying claims.

What is claimed is:

1. In a steel rolling mill, the in-line combination of (a) a Steckel mill for reversingly rolling a steel product above $T_{nr}$ to an interim reduced thickness and to obtain a controlled austenite recrystallization of the steel microstructure, and between $T_{nr}$ and $Ar_3$ to a target end-product thickness and to pancake the austentite microstructure, the Steckel mill having associated upstream and downstream coiler furnaces for coiling steel product of a suitable thickness and maintaining the temperature of the steel product above $T_{nr}$ to obtain a controlled recrystallization of the steel;

(b) a flying shear in the vicinity of the Steckel mill, for severing the leading edge of the steel product; and for steel product having a weight exceeding the capacity of a limiting apparatus in the combination, also for severing the steel product into a target portion having a weight within the capacity of the limiting apparatus, and a surplus portion; and (c) a controlled cooling apparatus downstream of the Steckel mill and the shear, the controlled cooling apparatus being operational to, in a single pass of the steel product therethrough following the rolling in the Steckel mill, reduce the temperature of the steel product from an entry temperature of about the $Ar_3$ to an exit temperature of at least about 200° C. lower than the $Ar_3$, at a cooling rate of about 12° C. to about 20° C. per second, in order to obtain a product having a relatively large amount of bainite and being relatively free of marsenite.

2. The combination as defined in claim 1 further comprising a reheat furnace upstream of the Steckel mill, for reheating the steel product to a suitable rolling temperature, wherein the maximum weight of the steel product to be processed by the combination is limited by the capacity of the reheat furnace.

3. The combination as defined in claim 2 wherein each coiler furnace comprises a plurality of pinch rolls for facilitating the full retraction of the target portion into the coiler furnace.

4. The combination as claimed in claim 1 further comprising an heat-retention furnace in-line and in the vicinity of the Steckel mill, for applying heat to the steel product to prolong the period of time during which the steel product recrystallizes above $T_{nr}$.

5. The combination as defined in claim 1, wherein the cooling rate is about 15° C. per second.

6. The combination as defined in claim 4, wherein the exit temperature is lower than the $Ar_3$ by about 250° C. to about 350° C.

7. The combination as defined in claim 4, wherein the exit temperature is in the range of 450° C. to about 600° C.

8. The combination as defined in claim 4, wherein the exit temperature is in the range of about 470° C. to about 570° C.

9. The combination as defined in claim 1 wherein a selected pancaking reduction from the interim reduced thickness to the target end product thickness is at least about 2:1.

10. The combination as defined in claim 9, wherein a selected recrystallization reduction from an initial pre-rolled thickness to the interim reduced thickness is at least about 1:5 to 1 and the combined recrystallization and pancaking reductions are at least about 3:1.

11. The combination as defined in claim 1, wherein the controlled cooling apparatus is a laminar flow cooling apparatus.

12. The combination as claimed in claim 1 wherein the shear located between the Steckel mill and controlled cooling apparatus.

13. The combination as claimed in claim 12 further comprising an optimization shear located upstream of the Steckel mill for severing the steel product into a target portion having a weight within the capacity of a limiting apparatus, and a surplus portion.

14. The combination of claim 12 further comprising a downstream shear located downstream of the controlled cooling apparatus, for cutting the steel product to length.

15. A method of optimizing the production of a steel rolling mill that includes a Steckel mill, the operation of said rolling mill being limited at least in part by an applicable limiting flow-through parameter being one of (i) at least one strip flow-through capacity parameter for a strip end-product, and (ii) at least one plate flow-through capacity parameter for a plate end-product;

the method including the rolling of a maximum-weight slab exceeding the applicable flow-through capacity parameter and the severing of the slab to obtain an end-product of a target weight and target dimensions, the target weight of the particular end-product of target dimensions being limited by the applicable limiting flow-through capacity parameter;

the Steckel mill having associated therewith upstream and downstream coiler furnaces capable of coiling plate up to coiler furnace thickness and weight limitations and downstream equipment for further processing and handling of the steel following its rolling;

the method comprising the steps of:

(a) flat-pass rolling the maximum-weight slab in the Steckel mill from a pre-rolled thickness to produce an interim steel product of a severable thickness exceeding the coiler furnace thickness limitation; then (b) transversely severing the interim steel product into two portions, viz a pre-determined target portion having a target weight selected to be within the coiler furnace weight capacity, and a residual surplus portion;

(c) flat-pass rolling the target portion in the Steckel mill to further reduce the target portion from the severable thickness to a thickness not exceeding the coiler furnace thickness limitation;

(d) coiling the target portion in one of the coiler furnaces;

(e) flat-pass rolling the surplus portion from the severable thickness to a desired surplus portion end-product thickness; then (f) transferring the surplus portion downstream for further processing to obtain a surplus end-product.

16. The method as claimed in claim 15, wherein in step (b) the weight of the target portion is within the plate flow through capacity of the steel rolling mill.

17. The method as claimed in claim 16 additionally includes after completion of step (f), (g) flat-pass rolling the target portion to a plate of desired target portion end-product thickness, then directing the target portion downstream for processing as plate end-product.

18. The method as claimed in claim 17 wherein the target portion is rolled from the pre-rolled thickness to a thickness not exceeding the coiler-furnace thickness limitation at a temperature above $T_{nr}$, and then rolled to the end-product thickness at a temperature between $T_{nr}$ and $Ar_3$, and wherein the target portion is maintained above $T_{nr}$ for a suitable period to enable controlled recystallization, and between $T_{nr}$ and $Ar_3$ to enable austenite pancaking.

19. The method as claimed in claim 18 additionally comprising after completion of step (g), (h) subjecting the target portion to controlled on-line cooling so as to reduce the temperature of the steel at a rate in the range of about 12° C. to about 20° C. per second to reach a temperature of at least about 200° C. to about 300° C. below the $Ar_3$, thereby to obtain a steel product of enhanced strength and toughness, having a composition including a substantial portion of fine-grained bainite.

20. The method as claimed in claim 15, wherein in step (b) the target weight is selected such that the target portion can be further rolled to obtain a target strip end-product whose weight and dimensions are at or below the at least one limiting strip flow-through capacity parameter.

21. A method as defined in claim 20, wherein the downstream equipment includes a strip coiler having a strip coiler capacity, and the limiting strip flow-through capacity parameter is the strip coiler capacity.

22. The method as claimed in claim 21 additionally including after completion of step (f), rolling the target portion to a strip of pre-determined end-product thickness within the strip coiler thickness capacity, then directing the target portion downstream for processing as strip end-product.

23. A method of processing steel, comprising:

in a recrystallization stage, (a) sequentially reversingly rolling a steel product in a Steckel mill for a selected number of flat-pass rolling passes performed while the steel is above the $T_{nr}$ in order to achieve a selected flat-pass reduction of the thickness of the steel product and to enable controlled austenite recrystallization of the steel during at least one of the flat-pass rolling passes;

(b) reversingly rolling the steel product in the Steckel mill for a selected number of recrystallization coiler passes performed while the steel is above the $T_{nr}$ in order to reduce the steel product to an interim thickness and to enable controlled austenite recrystallization, each said recrystallization coiler pass comprising reducing the steel product and then coiling and uncoiling the steel product in at least one of an upstream coiler furnace and a downstream coiler furnace, the total length of time of the recrystallization stage being dependent on the chemistry of the steel and being selected to enable suitably substantial austenite recrystallization of the steel;

(c) heating the coiler furnaces sufficiently to maintain the temperature of the steel product above the $T_{nr}$ while the steel product is being coiled and retained in the coiler furnaces during the initial recrystallization coiler passes;

in a pancaking stage, after the last of said recrystallization coiler passes, (d) reversingly rolling the steel product in the Steckel mill for a selected number of pancaking coiler passes performed while the steel is undergoing a declining temperature from about the $T_{nr}$ to about the $Ar_3$, in order to achieve a selected further reduction of the steel product to reach substantially the end-product thickness of the steel product, and to pancake the steel microstructure, each said pancaking coiler pass comprising reducing the steel product and then coiling and uncoiling the steel product in at least one of the coiler furnaces, then, in a cooling stage, immediately following completion of the coiler passes, (e) subjecting the steel product to controlled cooling during a single pass to reduce the temperature of the steel from a controlled entry temperature of about the $Ar_3$ to an exit temperature of at least about 200° C. lower than the $Ar_3$, at a cooling rate of about 12° C. to about 20° C. per second, thereby to obtain a steel product of enhanced strength and toughness, having a composition including a substantial portion of fine-grained bainite.

24. The method of claim 23, wherein the cooling rate is about 15° C. per second and the exit temperature is lower than the $Ar_3$ by about 250° C. to about 350° C.

25. The method defined in claim 24, wherein the selected reduction during the pancaking stage is in the order of 2:1.

26. The method as defined in claim 25, wherein the selected reduction during the recrystallization stage is at least about 1:5 to 1 and the overall combined recrystallization and pancaking reductions are at least about 3:1.

27. The method of claim 26, wherein the recrystallization and pancaking reductions achieve fine-grained austenite; and the controlled cooling progressively transforms most of the austenite into fine-grained bainite in the end-product.

28. The method of claim 27, wherein the controlled cooling exit temperature lies in the range of about 470° C. to about 570° C.

29. The method as defined in claim 28, wherein at least part of said controlled cooling is effected by laminar flow cooling.

30. The method of claim 23, wherein during the flat passes, the steel product is held for a pause period between reductions, to lengthen the recrystallization period.

31. The method of claim 30, wherein during the recystallization coiler passes, the steel product is held for a pause period in the coiler furnace, to lengthen the recrystallization period.

32. A method of processing steel, comprising:

in a recrystallization stage, (a) sequentially reversingly rolling a steel product in a Steckel mill for a selected number of flat-pass rolling passes performed while the steel product is above the $T_{nr}$, in order to achieve a selected flat-pass reduction of the thickness of the steel product and to enable a controlled recrystallization of the steel product during at least one of the flat-pass rolling passes, (b) maintaining the temperature of the steel product above $T_{nr}$ for a period of time sufficient to perform the selected number of flat-pass rolling passes, by applying heat to the steel product from an induction furnace located in-line and in the vicinity of the Steckel mill, the total length of time of the recrystallization stage being dependent on the chemistry of the steel and being selected to enable suitably substantial austenite recrystallization of the steel; then, in a pancaking stage, immediately following completion of the recrystallization stage, (c) further reversingly rolling the steel product in the Steckel mill for a selected number of pancaking passes performed while the steel is undergoing a declining temperature from about the $T_{nr}$ to about the $Ar_3$, in order to pancake the steel microstructure and to achieve a selected further reduction of the steel product to reach substantially the end-product thickness of the steel product, then, in a cooling stage, immediately following completion of the pancaking stage, (d) subjecting the steel product to controlled cooling during a single pass to reduce the temperature of the steel from a controlled entry temperature of about the $Ar_3$ to an exit temperature of at least about 200° C. lower than the $Ar_3$, at a cooling rate of about 12° C. to about 20° C. per second, thereby to obtain a steel product of enhanced strength and toughness, having a composition including a substantial portion of fine-grained bainite.

33. The method of claim 32, wherein the cooling rate is about 15° C. per second and the exit temperature is lower than the $Ar_3$ by about 250° C. to about 350° C.

34. The method defined in claim 33, wherein the selected reduction during the pancaking stage is in the order of 2:1.

35. The method as defined in claim 34, wherein the selected reduction during the recrystallization stage is at least about 1:5 to 1 and the overall combined recrystallization and pancaking reductions are at least about 3:1.

36. The method of claim 32, wherein the controlled cooling exit temperature lies in the range of about 470° C. to about 570° C.

37. The method defined in claim 36, wherein the selected reduction during the pancaking stage is of the order of 2:1.

38. The method as defined in claim 32, wherein the selected reduction during the recrystallization stage is at least about 1:5 to 1 and the overall combined recrystallization and pancaking reductions are at least about 3:1.

39. The method of claim 32, wherein the reductions achieve fine-grained austenite; and the controlled cooling progressively transforms most of the austenite into fine-grained bainite in the end-product.

40. The method as defined in claim 39, wherein at least part of said controlled cooling is effected by laminar flow cooling.

41. The method of claim 40, wherein during the recystallization stage, the steel product is held for a pause period in the induction furnace, to lengthen the recrystallization period.

42. The method as claimed in claim 40 wherein during the recrystallization stage and after step (a), the steel is reversingly rolled for a selected number of recrystallization coiler passes performed while the steel is above the $T_{nr}$ in order to reduce the steel product to an interim thickness, and to enable controlled austenite recrystallization, each said recrystallization coiler pass comprising reducing the steel and then coiling and uncoiling the steel in at least one of an upstream coiler furnace and a downstream coiler furnace, wherein the coiler furnaces are heated sufficiently to maintain the temperature of the steel above the $T_{nr}$ while the steel product is being coiled and retained in the coiler furnaces during the initial coiler passes.

43. The method as claimed in 42 wherein in step b, the further reversing rolling of the steel comprises sequentially reversingly rolling, coiling and uncoiling the steel in the Steckel mill and associated coiler furnaces for a selected number of pancaking coiler passes.

44. The method as claimed in claim 15, wherein between step (b) and (e), the surplus portion is moved upstream of the Steckel mill and is retained and heated while the surplus portion awaits further processing.

* * * * *

UNITED STATES PATENT AND TRADEMARK OFFICE

CERTIFICATE OF CORRECTION

PATENT NO. : 6,309,482 B1
DATED : October 30, 2001
INVENTOR(S) : Dorricott et al.

It is certified that error appears in the above-identified patent and that said Letters Patent is hereby corrected as shown below:

Column 3,
Line 40, change "theAr3" to -- the Ar3 --.

Column 5,
Line 21, after "FIG. 5 is" add -- a --.

Column 7,
Line 31, change "theTnr" to -- the Tnr --.

Column 8,
Line 17, replace "too thick to" with -- too thick --.
Line 48, after "having such" change "a" to -- an --.

Column 10,
Line 26, replace "controlled controlled" with -- controlled --.
Line 29, replace "controlled controlled" with -- controlled --.

Column 12,
Line 45, between "mouth" and "each" add -- of --.

Column 15,
Line 55, change "austentite" to -- austenite --.

Column 16,
Line 13, change "marsenite" to -- martensite --.
Line 24, change "an" to -- a --.
Line 44, change "1:5 to 1" to -- 1.5:1 --.
Line 50, between "shear" and "located" add -- is --.

Column 17,
Line 38, change "includes" to -- including --.
Line 64, change "the at least" to -- at least --.

Column 19,
Line 1, change "1:5 to 1" to -- 1.5:1 --.

UNITED STATES PATENT AND TRADEMARK OFFICE

CERTIFICATE OF CORRECTION

PATENT NO. : 6,309,482 B1
DATED : October 30, 2001
INVENTOR(S) : Dorricott et al.

It is certified that error appears in the above-identified patent and that said Letters Patent is hereby corrected as shown below:

Column 20,
Line 11, change "1:5 to 1" to -- 1.5:1 --.
Line 20, change "1:5 to 1" to -- 1.5:1 --.
Lines 29-30, change "recystallization" to -- recrystallization --.
Line 46, change "in 42" to -- in claim 42 --, and change "step b" to -- step (b) --.

Signed and Sealed this

Fourteenth Day of May, 2002

*Attest:*

*Attesting Officer*

JAMES E. ROGAN
*Director of the United States Patent and Trademark Office*